United States Patent [19]

Mitter

[11] 4,023,487

[45] May 17, 1977

[54] PRINTING MACHINE WITH PRINTING INK DISPENSING ARRANGEMENT

[75] Inventor: Mathias Mitter, Verl-Sende Mitte, Germany

[73] Assignee: Mitter & Co., Schloss Holte, Germany

[22] Filed: Aug. 13, 1974

[21] Appl. No.: 497,052

[30] Foreign Application Priority Data

Jan. 4, 1973 Germany ..... 2300289

[52] U.S. Cl. ..... 101/120; 101/366

[51] Int. Cl.[2] ..... B41F 15/40

[58] Field of Search ..... 101/116, 119, 120, 147, 101/350, 366, 364, 114, 115, 123, 129, 124; 137/87; 222/61, 64, 386.5, 389; 118/301, 323, 406

[56] References Cited

UNITED STATES PATENTS

| | | | |
|---|---|---|---|
| 1,739,264 | 12/1929 | Simpson | 101/115 |
| 2,928,340 | 3/1960 | Stein et al. | 101/120 |
| 3,326,123 | 6/1967 | Smalley | 101/366 |
| 3,439,609 | 4/1969 | Dorr | 101/366 |
| 3,631,800 | 1/1972 | Mignone | 101/350 |
| 3,651,756 | 3/1972 | Smith, Jr. | 101/147 |
| 3,796,155 | 3/1974 | Schluckebier | 101/366 X |
| 3,804,011 | 4/1974 | Zimmer | 101/120 |
| 3,890,896 | 6/1975 | Zimmer | 101/120 X |

FOREIGN PATENTS OR APPLICATIONS

| | | | |
|---|---|---|---|
| 186,221 | 10/1955 | Austria | 101/120 |
| 591,691 | 4/1959 | Italy | 101/114 |

*Primary Examiner*—Edgar S. Burr
*Assistant Examiner*—R. E. Suter
*Attorney, Agent, or Firm*—Michael J. Striker

[57] ABSTRACT

An enclosed receptacle has a plurality of outlet nozzles, and is subdivided into two compartments one of which communicates with the outlet nozzles and which are separated by a flexible diaphragm. A cushion of compressed gas is maintained in the other compartment, and an arrangement is provided for admitting printing ink into the compartment communicating with the outlet nozzles.

28 Claims, 19 Drawing Figures

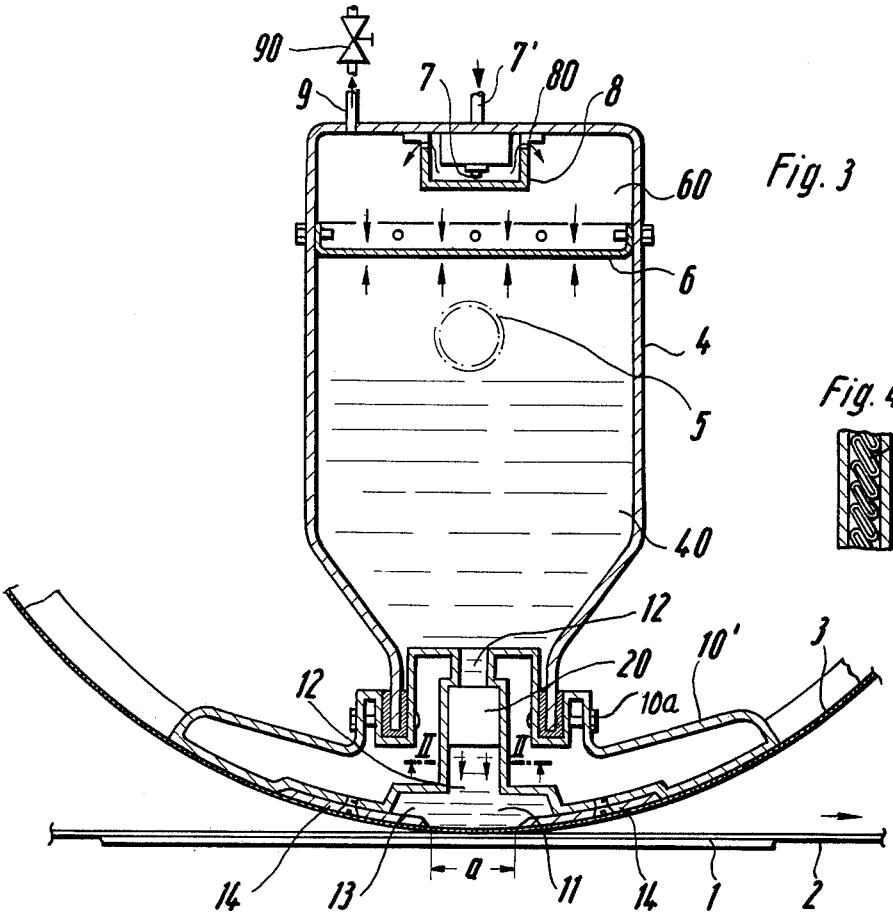
Fig. 3
Fig. 4
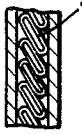
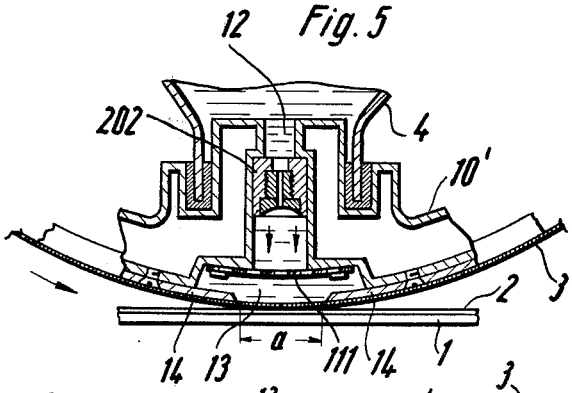
Fig. 5
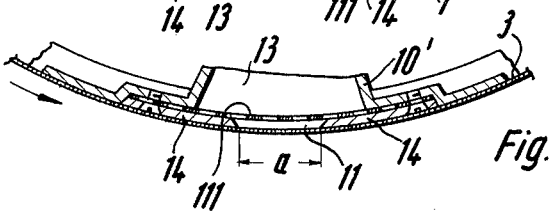
Fig. 6
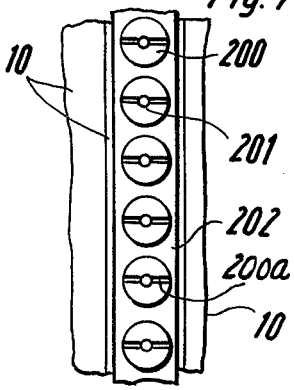
Fig. 7

PRINTING MACHINE WITH PRINTING INK DISPENSING ARRANGEMENT

BACKGROUND OF THE INVENTION

The present invention relates generally to a printing machine, and more particularly to a printing machine having a novel ink dispensing arrangement.

The present invention is particularly but not exclusively applicable to screen printing machines where it is highly advantageous. However, it is generally applicable wherever it is necessary to dispense liquid or pasty media, such as printing ink and the like.

Particularly screen printing machines have become very widely popular for printing of fabrics, such as woven and knitted fabrics, fibrous webs, paper, synthetic plastic foil, carpets, rugs and the like. In the case of screen printing machines the squeegee usually performs the dispensing function for dispensing the printing ink, that is for causing the printing ink to be squeezed through the openings in the printing screen. There are so-called roller squeegees which are rotated by friction, being located in the interior of a tubular printing screen and squeezing the printing ink through the perforations of the printing screen. There are also other types of squeegees which serve to wipe or otherwise force the printing ink through the perforations of the printing screen.

It is well known in the art that the depth to which the ink that has been dispensed through the printing screen, will penetrate into the workpiece, depends to a large extent upon the characteristics of the workpiece itself. In other words, the question of how much and how readily the workpiece will absorb liquid or a pasty printing ink is of great importance in determining the depth of penetration of the printing ink into the workpiece. Of course, the consistency of the printing ink in turn is of importance, because the more liquid the printing ink, the more readily it will penetrate into the workpiece. Also important is the period of time during which the material is afforded the possibility of penetrating, that is the speed at which any given portion of the workpiece moves out of the region in which printing ink penetrates into it through the printing screen. In many instances these three factors cannot be varied to suit particular requirements. The type of material for the workpiece is usually predetermined by the requirements of a particular job, so that its characteristics cannot be adapted to the printing requirements. Conversely, the consistency of the printing medium also cannot, as a rule, be varied because certain characteristics and consistencies are required of the ink. The third factor, namely the operating speed of the printing machine, also cannot usually be varied since a certain throughput per unit of time is required of the machine in order to obtain economic production.

This leaves a fourth factor which can sometimes be varied within a certain range, namely the level of the media sump from which the medium — such as the printing ink — passes through the printing stream. Theoretically, the higher the level of the sump, and therefore the greater the inherent weight of the medium that tends to force the medium adjacent the printing screen through the perforations of the latter, the greater the pressure at which the medium will be forced through these perforations. However, there are definite and relatively narrow limits within which variations can be made in this factor, because the level to which the sump can be built up can only be increased to a certain extent.

SUMMARY OF THE INVENTION

Accordingly, it is an object of the present invention to provide, in a printing machine, an improved ink dispensing arrangement.

More particularly, it is an object of the present invention to make it possible to vary at will the pressure exerted upon the medium in the medium sump, to thereby control the pressure and speed at which the medium will be expelled.

An additional object of the invention is to provide such an arrangement in which, due to the possibility of controlling the pressure and speed at which the medium is expelled through the perforations of the printing screen, the depth to which the medium penetrates into the workpiece can be controlled.

In keeping with the above objects, and with others which will become apparent hereafter, one feature of the invention resides, in a printing machine, in a combination which comprises an enclosed receptacle having outlet means, admitting means for admitting a body of printing ink into the receptacle, and means for maintaining a cushion of compressed gaseous fluid in the receptacle above the body of printing ink therein, to thereby control the outflow of printing ink from the outlet.

By varying the pressure of the cushion of compressed gaseous fluid, the pressure at which the printing ink is expelled can be precisely varied also, can be made uniform within a certain range, and can be accommodated to particular requirements. The pressure in the cushion of compressed gaseous fluid can for instance be on the order of 0.1 atmospheres, and a pump can be used to admit printing ink into the receptacle, which may raise the pressure in that part of the receptacle which accommodates the printing ink to a level of 0.12 atmospheres. The cushion of compressed gaseous fluid will become further compressed, since the printing ink cannot escape as rapidly through the perforations of the printing screen as it can be pumped in by the pump. Thus, the pressure of the cushion of fluid will also rise to approximately 0.12 atmosphere. When the printing ink now passes through the outlet means and through the printing screen, and if a uniform application of printing into onto the workpiece takes place, then the pressure in the receptacle drops again, for instance to 0.1 atmosphere. The pump may be made to turn on automatically in response to such a pressure drop, by providing a pressure sensing device in the receptacle and connecting it with the pump, whereupon the pump will admit additional printing ink into the receptacle and raise the level of pressure therein. This means that essentially a uniform pressure can be maintained, which will fluctuate only within a certain narrow range that can be precisely regulated, so that a uniform outflow of printing medium through the printing screen perforations is assured.

The novel features which are considered as characteristic for the invention are set forth in particular in the appended claims. The invention itself, however, such as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a fragmentary diagrammatic vertical section on line III—III of FIG. 2;

FIG. 4 is a fragmentary bottom-plan view, showing the outlet nozzles of the embodiment illustrated in FIGS. 1–3;

FIG. 5 is a fragmentary sectional detail view analogous to FIG. 3, illustrating a further embodiment;

FIG. 6 is a fragmentary sectional detail view, analogous to FIG. 5 but illustrating a modification of the embodiment shown in that FIG;

FIG. 7 is a fragmentary bottom-plan view of the nozzles used in the embodiment of FIG. 5;

DESCRIPTION OF THE PREFERRED EMBODIMENTS

Figure 1:
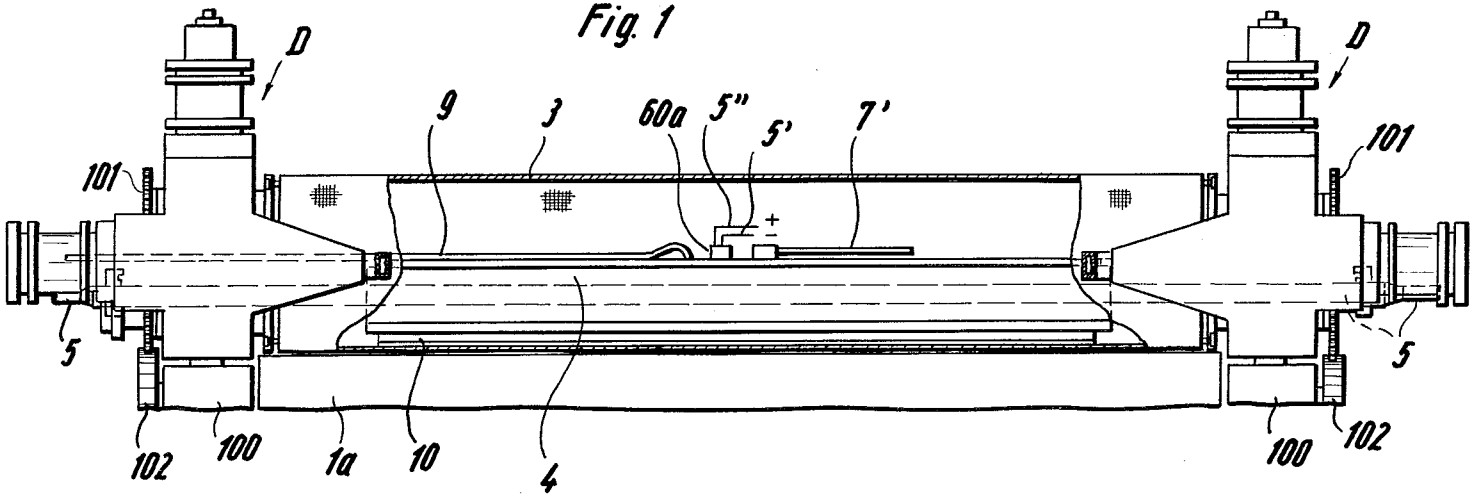
FIG. 1 is a somewhat diagrammatic, partially sectioned side view of an apparatus wherein the present invention is embodied in conjunction with a tubular printing screen.

Referring now to the drawing in detail, it is first pointed out that the dispensing arrangement of the present invention can be used in conjunction with any printing machine that requires the dispensing of printing ink, paste or the like, and that it can in particular be used with any type of screen printing machine that is known from the prior art, in lieu of the previously used printing ink dispensing arrangements.

FIG. 1 shows those portions of a screen printing machine which are of interest in the context of the present invention. This Figure is intended to provide a general concept as to where the arrangement of the present invention can be incorporated in such as screen a printing machine.

The machine of FIG. 1 has a pair of longitudinally spaced mounting heads D for a tubular printing screen 3. Located beneath the latter is a counter-pressure member 1*a*; the material to be printed passes through a gap between the printing screen 3 and the counter-pressure member 1*a*. A cylindrical roller squeegee 10 is located within the tubular printing screen 3 and journalled for rotation; it is accommodated within a receptacle 4 as will be described subsequently. Reference numeral 9 identifies a preferably flexible vent conduit via which the interior of the receptacle communicates with the exterior thereof. An admitting tube 5 serves to admit printing ink into the receptacle 4, whereas a preferably flexible tube 7′ serves to admit gaseous pressure fluid into the same receptacle. Electrical conductors 5′ and 5″ are connected with a switch 60*a* which controls a pump 50 (to be described with reference to FIG. 2).

The mounting heads D are supported on a machine frame 100. They each carry a gear 101 that is connected with one end of the tubular printing screen 3, and each gear is driven in rotation by meshing with a driven gear 102, so that the printing screen 3 rotates about its longitudinal axis when the gears 102 are driven in rotation.

Figure 2:
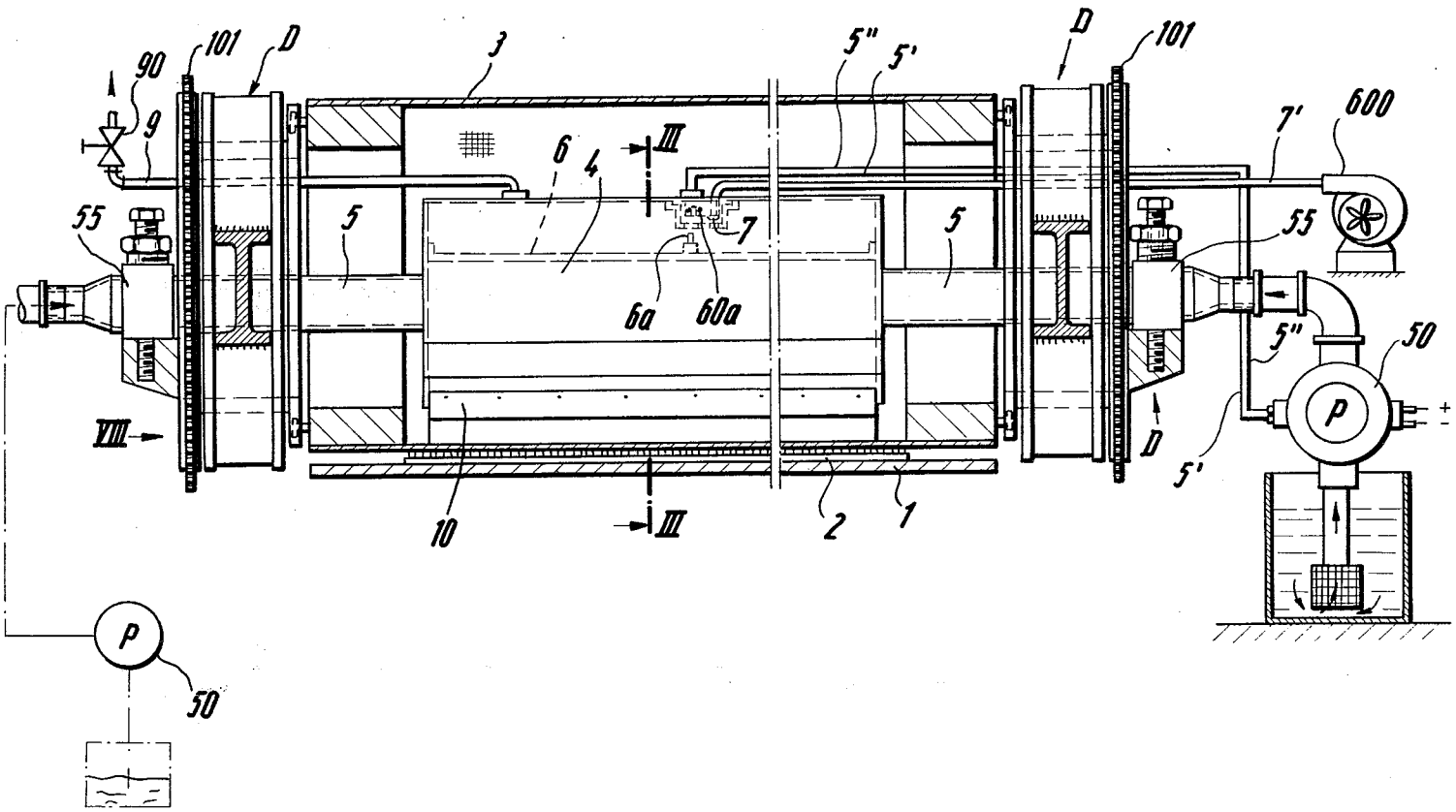
FIG. 2 is a vertical longitudinal section through the apparatus of FIG. 1, on an enlarged scale, and incorporating a slight modification.

FIG. 2 shows the apparatus of FIG. 1 in more detail. For clarity of illustration, the mounting heads D are only fragmentarily illustrated in FIG. 2.

It will be seen in this Figure that the conductors 5′ and 5″ connect the switch 60*a* with the pump 50. The receptacle 4 is subdivided into an upper and a lower chamber by a flexible diaphragm 6; details will be described with reference to FIG. 3, The tube 7′ communicates with the upper chamber, the tubes 5 —of which are provided in this Figure--with the lower one. The diaphragm 6 carries a projection of finger 6*a* which is so positioned that when the diaphragm 6 flexes upwardly (in this particular embodiment) the projection 6*a* will operate the switch 60*a* in a sense interrupting the circuit of pump 50 so that the latter, which supplies printing ink into the lower chamber, ceases its operation. Conversely, when the diaphragm 6 flexes downwardly from the position in which the circuit is interrupted, the projection 6*a* disengages the switch 60*a* and the circuit to pump 50 is completed, so that the pump starts up again and begins to supply ink into the lower chamber.

It is clear from FIG. 2 that two separate pumps 50 are provided, both controlled by the switch 60*a* and each supplying ink through one of the two tubes 5 which enter the receptacle from opposite axial ends of the printing screen 3. However, it should be understood that a single one of these pumps could supply printing ink to both of the tubes 5, if so desired.

The vent 9 is provided with a relief valve 90 which can be so adjusted that the pressure of gaseous fluid in the upper chamber —i.e. above the diaphragm 6— will not exceed a predetermined limit, for example 0.12 atmospheres. When the pressure limit is exceeded, the valve 90 opens and then functions as a safety valve. If it is desired to maintain the pressure constant, then the source of pressurized gaseous fluid —e.g. the blower 600— which is connected with the conduit 7′ can be operated continuously, in which case the valve 90 will open whenever the pressure begins to exceed the predetermined limit and will close when the pressure has again dropped to this limit, thus maintaining the pressure essentially constant.

Discussing now FIG. 3, it will be seen that reference numeral 1 identifies a support which is also shown in FIG. 2 and can be provided in any desired manner on the printing machine frame 100. On the support 1 is located the workpiece 2, for instance a web of woven material, which advantageously advances continuously and the upper surface of which is in contact with the tubular printing screen 3 when printing operation is carried out. It should be pointed out that although a tubular printing screen has been illustrated, the invention is equally applicable with a flat printing screen or any other type of printing screen that is conventional in the art.

The enclosed receptacle 4 is provided at the inside of the tubular printing screen 3 which is provided with the inlet tube 5 that can be located anywhere and has been shown only in broken lines in FIG. 3. The inlet tube 5 is the one shown in FIG. 1, or it may be one of the two shown in FIG. 2. The receptacle 4 may extend over the entire axial length of the printing screen 3.

The receptacle 4 is subdivided in its interior by the aforementioned flexible diaphragm 6 so as to form the upper chamber in which the cushion of compressed gaseous fluid 60 can develop, and the lower chamber in which printing ink will be present. The term "printing ink" as used herein includes all types of printing media, including liquid and pasty inks. Pressure can be built up in the chamber above the diaphragm 6 by means of compressed air inlet nozzle 7 which communicates with a non-illustrated source of pressure (see the source 600 in FIG. 2), for instance of compressed air. A substantially U-shaped box 8 is provided which surrounds the nozzle 7 at the interior of the receptacle 4 and is provided at its upper end with lateral openings 80 which assure that the admitted compressed air (or other gaseous fluid) can enter the chamber above the diaphragm 6. A vent 9 is provided through which air can be vented outside the receptacle 4; the vent 9 is closed in suitable manner until and unless it is required to be opened. For instance, the safety relief valve 90 can be installed in the vent 9.

The lower region of the receptacle 4 is connected with a squeegee member 1' —which in FIG. 3 is not a roller squeegee— having a surface that is complementary to the inner surface of the printing screen 3, and having a slot-shaped opening 11 adjacent the printing screen which extends longitudinally of the printing screen 3 and of the squeegee 10'. The width of the opening 11 may vary within the range *a* over the length of the opening and the opening may diverge towards the printing screen 3. Above the slot-shaped opening 11 there is provided a row of outlet nozzles 20 which may be arranged in the manner shown in FIG. 4, but which can also be nozzle members 200 that are threaded individually into a strip-shaped mounting member 202 as shown in FIGS. 5 and 7. The squeegee 10' has a further slot 12 above the nozzles 20 through which ink reaches the latter.

By exchanging the nozzles 20 for others having different outlet openings, that is having outlet openings whose cross-section differs from those previously installed, different inkflow speeds are obtainable and thereby the depth of penetration of the ink per unit of time and per square centimeter can be varied. The possibility of exchanging the nozzles is also important to compensate for different viscosities of the printing ink, for instances in the event the printing ink should be very liquid. The outlet openings of the nozzles may overlap to the extent of one-quarter, one-third or one-half, or to other extents, depending upon particular requirements. Several rows of nozzles may be utilized, and the nozzles may be flat-jet nozzles as in FIGS. 3 and 4, that is nozzles which eject flat jets of printing ink. If the printing ink is of a pasty consistency, then the space below the nozzles 20 in the squeegee 101 may be filled completely with printing ink, throughout the entire printing operation. However, if the printing ink is very liquid, then a direct flow of printing ink from the nozzles 20 (that is the flat-jet nozzles of FIGS. 3 and 4) or from the nozzles 200 and the outlet openings 201 thereof (shown in FIGS. 5 and 7) will take place.

The configuration of the squeegee 10' as a hollow body, and the particular cross-sectional shape thereof, can of course be varied. What is important is that the squeegee 10' should be in direct engagement with the printing screen 3, in such a manner that damage will occur neither to the printing screen nor to the squeegee during relative movements between the same, for instance when the printing screen 3 is tubular and rotates at relatively high speed. On the other hand, the squeegee 10' must assure that no ink will penetrate laterally of the squeegee, that is that all ink will penetrate only through the printing screen 3. The squeegee 10' can be removably connected with the receptacle 4 (e.g. by belts 10*a* as in FIG. 3), and it goes without saying that the receptacle 4 and the squeegee 10 must be mounted in the interior of the printing screen 3 in such a manner as to be stationary with reference to the same, so that the printing screen 3 will rotate (or otherwise become displaced) with reference to the squeegee 10' and the receptacle 4. However, since the manner in which such mounting can be effected is entirely conventional in the art, it has been illustrated only diagrammatically (see FIGS. 2 and 8).

In operation of the arrangement according to the present invention, compressed gas or air is admitted into the space of the receptacle above the diaphragm 6, until the cushion 60 has been produced and has the desired pressure of for instance 0.1 atmospheres. The pump 50 now admits printing ink into the receptacle 4 below the diaphragm 6, until the space below the diaphragm 6 is substantially filled. This causes the pressure in the interior of this space to be raised, for instance to 0.12 atmosphere, and this increased pressure is communicated via the diaphragm 6 to the cushion 60 which now also will have substantially the same pressure. Once the desired pressure is reached, further admission of printing ink via the tube 5 is terminated (compare the operation of switch 60*a* in FIG. 2), and the arrangement is ready for operation. As ink is expelled through the printing screen 3, the pressure in the interior of the receptacle 4 will of course drop, for instance to approximately 0.1 atmospheres. A sensor can be provided in the interior of the receptacle 4 which, when it senses a pressure drop to a certain level, can switch the pump 50 on again. Such sensors are entirely conventional in many fields and require no detailed discussion. The switching-on can also be effected via the switch 60*c* and the finger 6*a*, as described before. When the pump is switched on again, it admits additional ink into the receptacle 4, causing the pressure to rise again and the sensor or the cooperation of finger 6*a* with switch 60*a* will then switch the pump off again when the present level has been reached. This means that a constant relatively uniform pressure will be present in the receptacle 4, so that a uniform outflow of printing ink through the perforations of the printing screen 3 is assured. In this connection it is pointed out that the slot 11 could be covered by a perforated sheet or the like, if desired.

It is evident that the diaphragm 6 could be replaced with another component; for instance, a bag means containing a cushion of compressed gaseous fluid could be accommodated in the receptacle 4. The configuration of the squeegee could also be changed, although the particular configuration which has been shown has the advantage of affording a uniform contact surface with respect to the printing screen 3, and of providing the least possible wear upon the highly wear-susceptible printing screen 3.

For particular requirements it is possible to provide in the slot 12 or in the enlarged space 13 a roller squeegee, or a squeegee of the doctor-blade type. Ordinarily, this will not be necessary but if the particular consistency of a printing ink should require the provision of such special members, they can be readily included. Removable plates 14 at the underside of the squeegee may also be provided, and they may be of synthetic plastic material or the like. These can define between themselves the width of the opening through which the ink can have access to the printing screen 3. The squeegee need not be hollow, as illustrated, but could also be solid. It is also possible to switch the pump on and off by means other than those which have been discussed above. For instance, switches could be provided which are activated by the flexing of the diaphragm 6. The material of the latter can be selected at will, for instance it can be natural or synthetic rubber.

Figure 9:
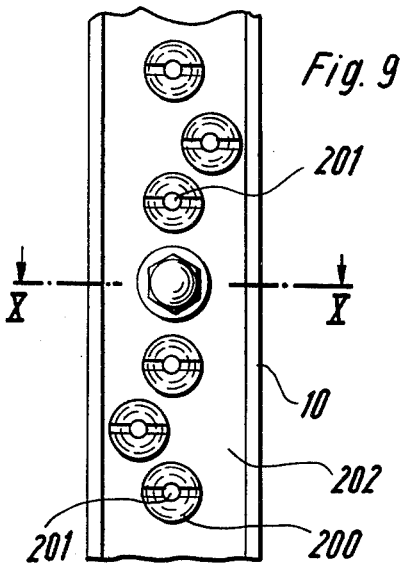
FIG. 9 is a view amalogous to FIG. 7, but illustrating another embodiment.
Figure 10:
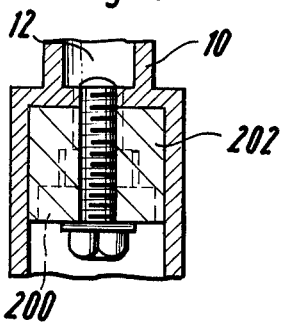
FIG. 10 is a section taken on line X—X of FIG. 9.

FIGS. 5 and 7 are essentially analogous to FIGS. 3 and 4, but show a particular arrangement of the nozzles. This embodiment has the advantage that the nozzles 200 can be readily threaded into and out of a support 202, so that they can be exchanged for others having different flow-through cross-sections, depending upon the particular printing ink and the consistency thereof. For instance, the outflow cross-sections of the nozzles may be varied between 0.02 and 0.07 millimeters, depending upon the particular nozzle chosen. If the printing ink is relatively viscous, the largest outflow cross-section of the bores 201 in the nozzles 200 will be utilized, and of course it can be even larger than 0.07 millimeters if and when required. To facilitate the exchange of the nozzles 200 for other nozzles 200 having a bore 201 of a different cross-sectional area or shape, the underside of the nozzles may be provided with slots 200*a* (see FIG. 7) for insertion of the blade of a screwdriver or other tool, so as to more readily turn the nozzles 200. The member 202 which carries the nozzles 200 is provided with a plurality of tapped openings (one shown in FIG. 5) into which the nozzles 200 are threaded. It may also be provided with two or more rows of such openings, so that two or more rows of the nozzles 200 can be provided, as shown in FIGS. 9 and 10 which are otherwise self-explanatory. In this case it is advantageous if each nozzle 200 of one row is located intermediate two nozzles 200 of the laterally adjacent row. The embodiment of FIGS. 5 and 7 makes it possible to use printing inks whose consistency varies within a wide range, and to accommodate the discharge of printing ink quite precisely to the operating speed of the printing machine and to the characteristics of the workpiece being printed. If only a very simple arrangement is required, then the nozzles 20 of FIGS. 3 and 4 or the nozzles 200 of FIGS. 5 and 7 may be replaced by small slot-shaped openings extending lengthwise of the squeegee 10′. One or more of these openings may be provided and they may be made adjustable in their width. However, the use of the nozzles 20 or 200 has the advantage that better control is afforded and better distribution of the ink over the entire width of the machine, that is the entire axial length of the tubular printing screen 3, or the width of a flat printing screen that might be used in lieu of a tubular printing screen.

In FIG. 5, the space 13 above the slot-shaped opening through which the printing ink reaches the printing screen 3, is separated from the nozzles 200 by a screen insert 111 which serves to assure a more even distribution of the printing ink over the width and length of the space 13 and hence of the slot-shaped opening.

FIG. 6 is analogous to FIG. 5, but illustrates that the screen insert 111 can also be located elsewhere, namely be mounted on the squeegee 10′ itself as shown.

Figure 8:
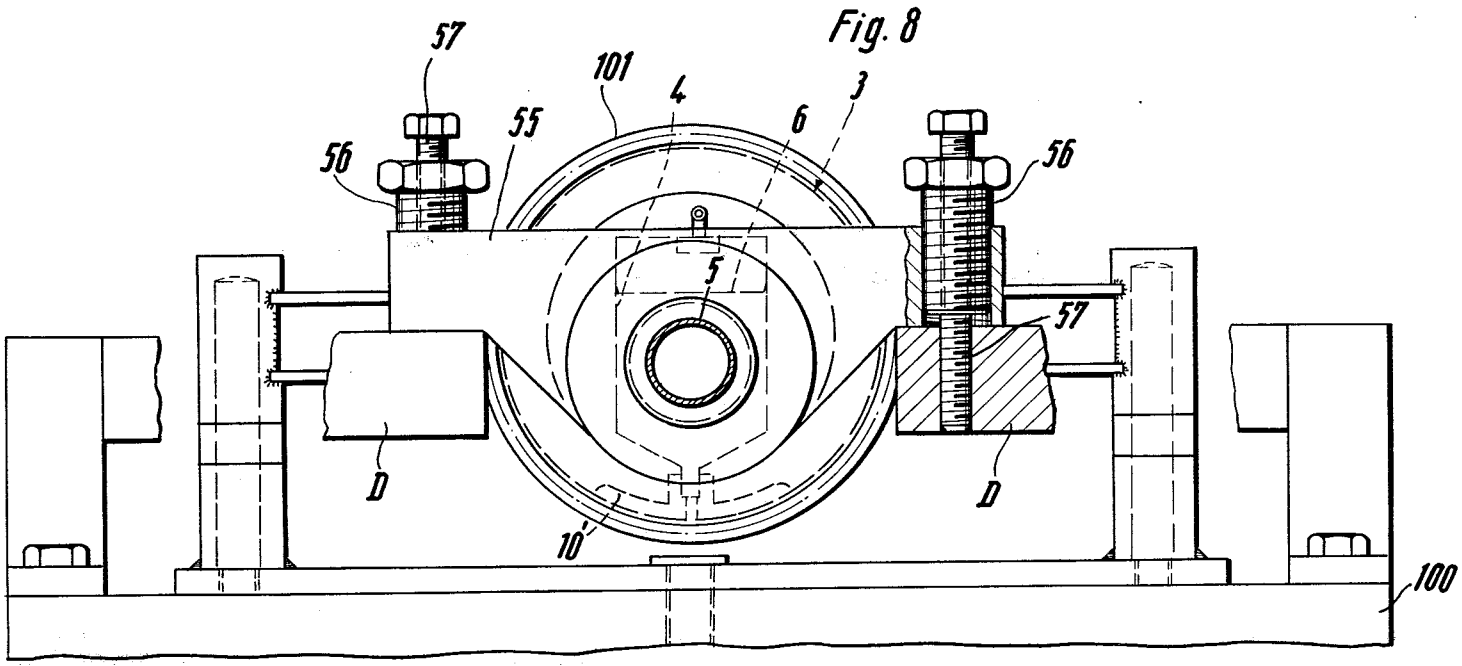
FIG. 8 is a partly sectioned end view, looking in the direction of arrow VIII in FIG. 2 but illustrating a further embodiment of the invention.

FIG. 8 shows how the single tube 5 can be mounted on the machine frame 100; the explanation applies analogously to two of the tubes 5, of course. Journals 55 (one shown) are provided at the opposite ends of the printing screen 3 wherein the tube 5 is supported.

Tubular bolts 56 are threaded into tapped vertical bores in the journals 55, and mounting bolts 57 are threaded through the bolts 56 and into tapped bores in the diagrammatically shown mounting heads D. Thus, turning of the bolts 56 in one or the other direction permits the respective journals 55 (and with them the tube or tubes 5) to be raised or lowered.

Figure 11:
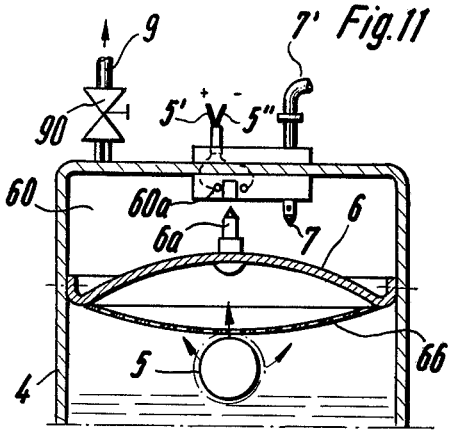
FIG. 11 is a section analogous to that of FIG. 3, but illustrating a different embodiment of the invention.

FIG. 11 illustrates an embodiment which is essentially analogous to FIGS. 1–3, so that like reference numerals have been used to identify like elements. FIG. 11, however, additionally shows a protective screen 66 which is located beneath the diaphragm 6, in the lower chamber of the receptacle 4. The purpose of the screen 66 which can be of metal, or of synthetic plastic as illustrated, is to protect the diaphragm 66 in the event the pressures of the body 60 of pressure fluid in the upper changer should become excessive, for example if the valve 90 is improperly set and permits each excessive pressure to develop. In such a case, the diaphragm 6 might be flexed into the lower chamber to such an extent that it could rupture. The screen 66 prevents this possibility, since it permits flexing of the diaphragm into the lower chamber only to a limited extent; once the diaphragm 6 engages the screen 66, further flexing is impossible and the diaphragm is thus protected against rupture.

Figure 12:
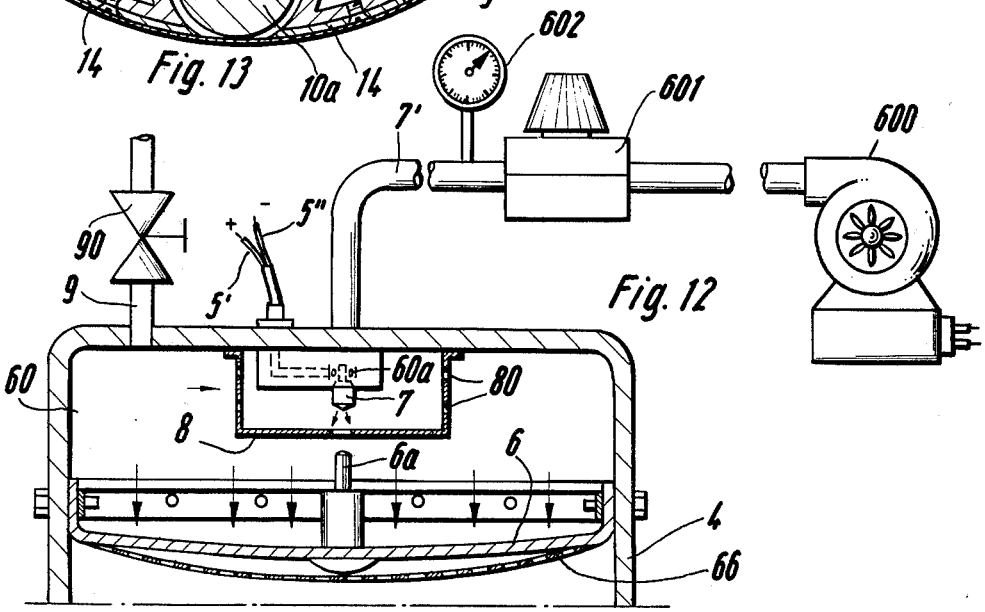
FIG. 12 is a partly sectioned view illustrating a further embodiment of the invention.

FIG. 12, wherein like reference numerals again identify like elements as in the preceding Figures, shows how a pressure-regulating device 601 may be interposed in the tube 7′ intermediate the source 600 and the receptacle 4, together with a pressure gauge 602. The device 601, which is in the nature of a conventional valve, can be used by an operator to adjust the supply of pressurized gaseous fluid to the receptacle 4, based upon the indications furnished by the gauge 602 of the pressure which prevails in the upper chamber of the receptacle 4.

Figure 13:
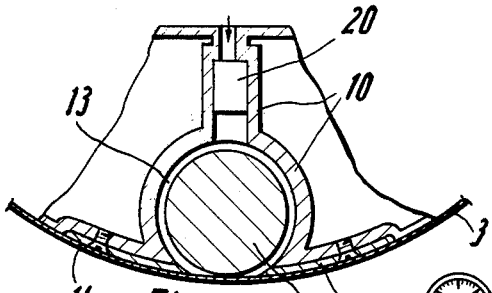
FIG. 13 is a sectional view illustrating still an additional embodiment of the invention.

FIG. 13 shows that the squeegee may also be in form of a roller squeegee 10*a*. The construction is quite similar to that of FIG. 3, except that here the element 10′ of FIG. 3 serves as a housing for the roller portion 10*a* of the squeegee 10, and does not itself perform a squeegee function. Instead, the space 13 is formed to have a substantially cylindrical cross-section, and the roller portion 10*a* is freely rotatably and with clearance accommodated in the space 13, having its circumferential surface in engagement with the inner surface of the printing screen 3.

FIGS. 14-19, finally show how a single ink-supply tube 5 can be used, which extends over the entire axial length of the receptacle 4 and of the printing screen 3. The latter is again of the tubular rotary type, its direction of rotation being indicated by the arrow in FIG. 14. The tube 5 has outlet openings 51 for the ink, which are so located as to discharge ink from the tube 5 into the receptacle 4.

Figure 14:
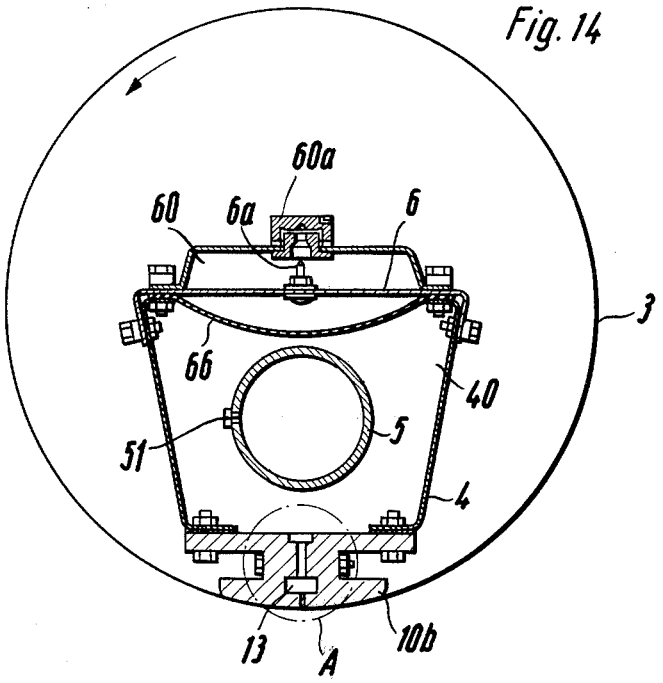
FIG. 14 is a vertical cross-section through yet another embodiment of the invention.
Figure 15:
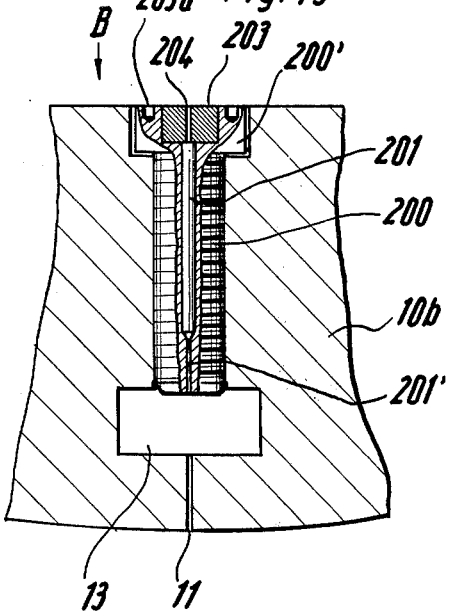
FIG. 15 is a fragmentary sectional view, illustrating a detail of FIG. 14 on an enlarged scale.

Reference numeral 10b in FIG. 14 identifies the lower portion of the squeegee; this portion is shown in more detail and on an enlarged scale in FIG. 15. It will be seen from the latter FIG. that the nozzles 200 through which the ink reaches the printing screen 3, are threaded into the portion 10*b* and discharge into the space 13 formed within the portion 10*b*. The space 13 in turn communicates with a slot 11 which is quite narrow, i.e. much narrower than the dimension *a* shown in FIG. 3. This embodiment is evidently most suitable for a very liquid ink, whereas the embodiment of FIG. 3, for example, is more suitable for pasty ink because of the larger dimension *a*.

The nozzles 200 in FIG. 15 (one shown) have very small-diameter outlet bores 201′ which discharge into the space 13. While it might be desired to have these bores 201′ of the same small diameter over their entire axial length, this is difficult to achieve in actual practice, and therefore only the outlet end portion of each nozzle 200 is provided with the small-diameter bore 201′ while, at other end (i.e. the inlet end portion 200′) an insert 203 is installed in an axial recess formed in the end portion 200′. This insert 203 is provided with a bore 204 having a diameter corresponding to that of the bore 201′. The bores 201′ and 204 are connected by a larger-diameter bore 201 (which can be more readily produced) whose larger diameter is not disadvantageous, because the ink flow is controlled by the smaller-diameter bores 204 and 201′.

Figure 16:
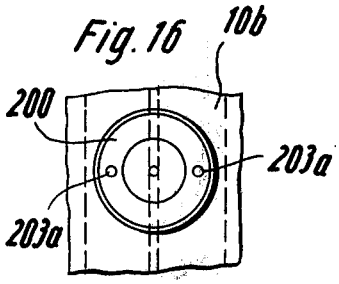
FIG. 16 is a view of FIG. 15 as seen in the direction of the arrow B in that Figure.

FIG. 16, a top-plan view of FIG. 15 in direction of the arrow B, is self-explanatory. The depressions 203*a* —see also FIG. 15— serve for insertion of a suitable tool by means of which the nozzles 200 can be inserted into and out of the respective tapped openings in the squeegee portion 10*b*.

Figure 17:
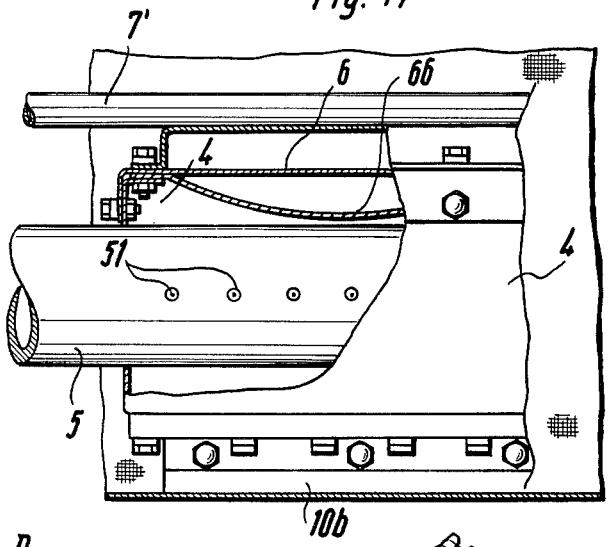
FIG. 17 is a partly sectioned view, illustrating a detail of another embodiment of the invention.

FIG. 17 shows one end of the embodiment in FIGS. 14–16, with the wall of receptacle 4 broken away to show how the outlet openings 51 of tube 5 are oriented, and how tube 5 extends through the one end wall of the receptacle 4. It will be evident that it is immaterial whether the ink is supplied from the left-hand end of the arrangement, as will be seen to be the case in FIG. 17 from the fact that it is at this end that the end 15 projects outwardly of the receptacle 4 to the (not visible) source of supply, or from the right-hand end.

Figure 18:
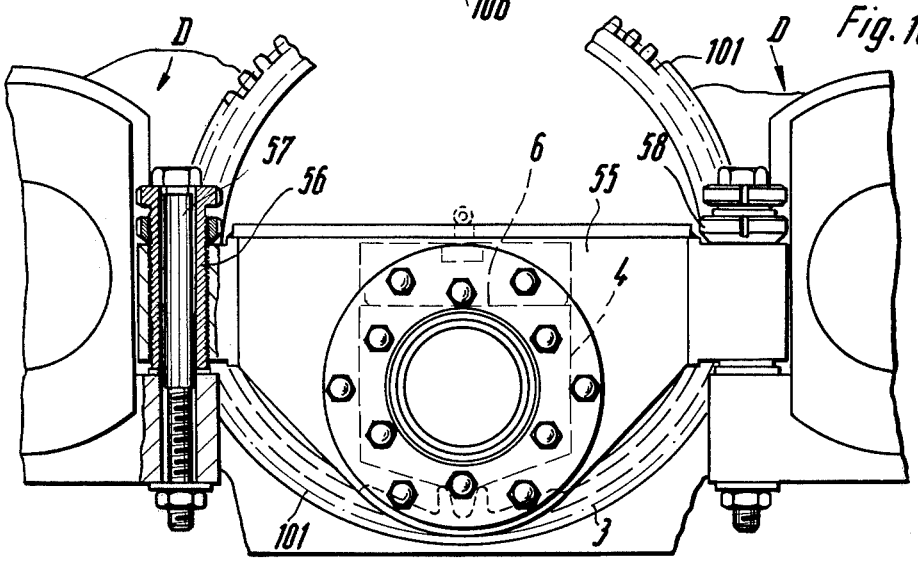
FIG. 18 is a partly sectioned end view of FIG. 17, showing some portions which are not visible in that Figure and omitting some other portions for the sake of clarity.
Figure 19:
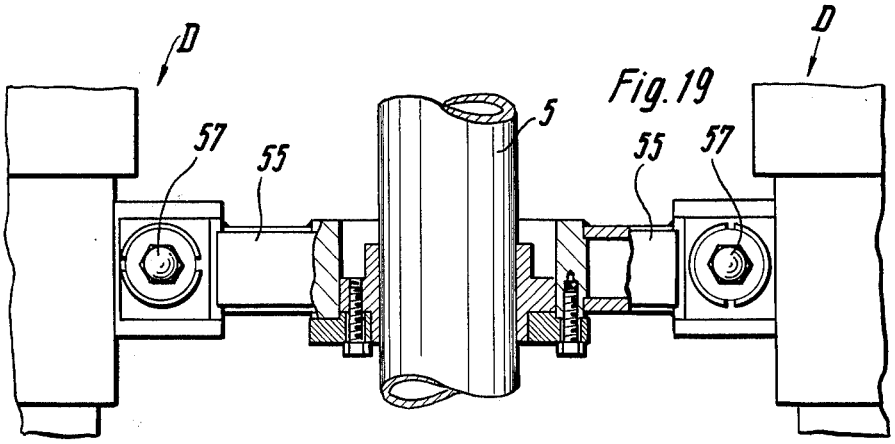
FIG. 19 is a top-plan view of FIG. 18, showing some portions in section.

FIGS. 18 and 19, finally, are an end view and a top plan view, respectively, of the embodiment in FIGS. 14–17. Some elements shown in those Figures are omitted in FIGS. 18–19, while FIGS. 18–19 show some elements that have not been illustrated in FIGS. 14–17. FIGS. 18–19 are self-explanatory; they show details of the FIGS. 14–19 embodiment which can be readily understood by reference to the embodiment illustrated in FIG. 8. In fact, like reference numerals are used in FIGS. 18–19 to designate like elements as in FIG. 8. An additional component found in FIGS. 18–19 are the counter nuts 58 which are threaded onto the tubular bolts 56 and serve to assure that adjustment of the journals 55 will take place only when it is desired (and after loosening the counter nuts 58), not as a result of vibrations or the like which might cause the tubular bolts 56 to turn in the absence of the counter nuts 58.

While only one journal 55 is shown in FIGS. 18–19, it will be understood that there will be two of them provided, one at each end of the printing screen 3. The latter is, incidentally omitted from FIGS. 18–19 for the sake of clarity.

It will be understood that each of the elements described above, or two or more together, may also find a useful application in other types of constructions differing from the types described above.

While the invention has been illustrated and described as embodied in a printing machine, it is not intended to be limited to the details shown, since various modification and structural changes may be made without departing in any way from the spirit of the present invention.

Without further analysis, the foregoing will so fully reveal the gist of the present invention that others can by applying current knowledge readily adapt it for various applicatons without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a printing machine, a combination comprising an enclosed printing ink receptable having outlet means for outflow of printing ink; admitting means for admitting a body of printing ink into said receptacle; means for maintaining a cushion of compressed gaseous fluid in said receptacle above said body of printing ink therein, to thereby control the outflow of printing ink from said outlet means, said means for maintaining comprising a flexible diaphragm subdividing the interior of said receptacle into a lower chamber containing said body of ink and an upper chamber containing said cushion of compressed gaseous fluid, the pressure in each of said chambers being responsive to fluctuations of pressure in the other chamber; a printing screen proximal to said receptacle and having a first side facing said outlet means and a second side to be juxtaposed with a workpiece; a member mounted between said outlet means and said first side, in contact with the latter, and having a longitudinal slot communicating with said first side and also with said outlet means; and control means for varying the compression of said cushion of compressed gaseous fluid in said upper chamber when it is desired to thereby vary the pressure in said lower chamber.

2. A combination as defined in claim 1 further comprising flat-jet nozzles located in said slot.

3. A combination as defined in claim 2, wherein said nozzles are oriented to eject flat jets of printing ink which are inclined with reference to the direction of movement of said printing screen.

4. A combination as defined in claim 1, wherein said outlet means includes a row of nozzles and a slot-shaped opening formed intermediate said nozzles and said printing screen and diverging toward the latter, the width of said slot-shaped opening being adjustable.

5. A combination as defined in claim 1, wherein said slot extends over the entire length of said member; and wherein the latter is hollow and has an exterior surface which at least in part corresponds in its contour to the contour of said other side of said printing screen.

6. A combination as defined in claim 5, wherein said printing screen is tubular.

7. A combination as defined in claim 1, wherein said member is removably connected with said receptacle.

8. A combination as defined in claim 1, wherein said member includes removable plate portions which define with one another said slot.

9. A combination as defined in claim 1; and further comprising a perforated cover overlying said slot.

10. In a printing machine, a combination comprising an enclosed printing ink receptacle having outlet means for outflow of printing ink; admitting means for admitting a body of printing ink into said receptacle; means for maintaining a cushion of compressed gaseous fluid in said receptacle above said body of printing ink therein, to thereby control the outflow of printing ink from said outlet means, said means for maintaining comprising a flexible diaphragm subdividing the interior of said receptacle into a lower chamber containing said body of ink and an upper chamber containing said cushion of compressed gaseous fluid, the pressure in each of said chambers being responsive to fluctuations of pressure in the other chamber; a printing screen proximal to said receptacle and having a first side facing said outlet means and a second side to be juxtaposed with a workpiece; a member including a portion formed with a longitudinal slot including an elongated chamber of substantially cylindrical cross-section and having a slot-shaped outlet opening adjacent said printing screen, said member further comprising a cylindrical roller portion freely turnably received in said chamber and in contact with said other side of said printing screen and said outlet means including a row of nozzles spaced inwardly of said outlet opening and said chamber; and control means for varying the compression of said cushion of compressed gaseous fluid in said upper chamber when it is desired to thereby vary the pressure in said lower chamber.

11. In a screen printing machine, a combination comprising an enclosed elongated printing ink receptacle having an upper part, and a lower part provided with flow-restricting outlet nozzle means for outflow of printing ink; admitting means for admitting a body of printing ink into said receptacle; means for maintaining a cushion of compressed gaseous fluid in said receptacle above said body of printing ink therein, to thereby exert a uniform pressure on the printing ink over the entire elongation of said receptacle and control the outflow of printing ink from said outlet nozzle means, said means for maintaining comprising a flexible diaphragm subdividing the interior of said receptacle into a lower chamber in said lower part and containing said body of ink and an upper chamber containing said cushion of compressed gaseous fluid, the pressure in each of said chambers being responsive to fluctuations of pressure in the other chamber, and control means for varying the compression of said cushion of compressed gaseous fluid in said upper chamber when it is desired to thereby vary the pressure in said lower chamber; and a movable printing screen having one side facing said outlet means and another side juxtaposable with a workpiece.

12. A combination as defined in claim 11; further comprising a member between said outlet means and said other side in contact with the latter; said member having a longitudinal slot facing said other side and with which said outlet means communicate.

13. A combination as defined in claim 11, further comprising a member including a portion formed with a longitudinal slot, said outlet means including a row of nozzles and an elongated chamber of substantially cylindrical cross-section formed within said slot intermediate said nozzles and said printing screen, said chamber having a slot-shaped outlet opening adjacent said printing screen; and wherein said member further comprises a cylindrical roller portion freely turnably received in said chamber and in contact with said other side of said printing screen.

14. A combination as defined in claim 13; and said means for maintaining comprising a compressed-air inlet nozzle communicating with said upper chamber.

15. A combination as defined in claim 14, and further comprising a box-shaped baffle surrounding said nozzle and interposed between the same and said diaphragm, said baffle having openings communicating with the interior of said upper chamber.

16. A combination as defined in claim 15; and further comprising a vent communicating with said upper chamber for venting gaseous fluid from the same.

17. In a screen printing machine, a combination comprising an enclosed elongated printing ink receptacle having an upper part, and a lower part having an elongated member provided with flow-restricting outlet nozzle means in form of at least one row of exchangeable nozzles for outflow of printing ink; admitting means for admitting a body of printing ink into said receptacle; and means for maintaining a cushion of compressed gaseous fluid in said receptacle above said body of printing ink therein, to thereby exert uniform pressure on the printing ink over the entire elongation of said receptacle and control the outflow of printing ink from said outlet nozzle means, said means for maintaining comprising a flexible diaphragm subdividing the interior of said receptacle into a lower chamber in said lower part and containing said body of ink and an upper chamber containing said cushion of compressed gaseous fluid, the pressure in each of said chambers being responsive to fluctuations of pressure in the other chamber, and control means for varying the compression of said cushion of compressed gaseous fluid in said upper chamber when it is desired to thereby vary the pressure in said lower chamber.

18. A combination as defined in claim 17, wherein said elongated member is formed with a plurality of tapped openings; and wherein said nozzles are threaded into said openings.

19. A combination as defined in claim 17, wherein said nozzles have outlet openings of between substantially 0.02 and 0.07 mm diameter.

20. A combination as defined in claim 17, wherein said nozzles have inner ends facing inwardly of said receptacle, and outer ends facing outwardly of said receptacle, said nozzles being formed with outlet openings, and with slots which are provided in said outer ends and intersect the respective outlet openings, said slots being dimensioned to receive a tool by which to turn said nozzles.

21. In a screen printing machine, a combination comprising an enclosed elongated printing ink receptacle having an upper part, and a lower part provided with flow-restricting outlet nozzle means for outflow of printing ink, said nozzle outlet means comprising at least two parallel rows of outlet nozzles, the nozzles of one row being staggered relative to the nozzles of the other row; admitting means for admitting a body of printing ink into said receptacle; and means for maintaining a cushion of compressed gaseous fluid in said receptacle above said body of printing ink therein, to thereby exert a uniform pressure on the printing ink over the entire elongation of said receptacle and control the outflow of printing ink from said outlet nozzle means, said means for maintaining comprising a flexible diaphragm subdividing the interior of said receptacle into a lower chamber in said lower part and containing said body of ink and an upper chamber containing said cushion of compressed gaseous fluid, the pressure in each of said chambers being responsive to fluctuations of pressure in the other chamber, and control means for varying the compression of said cushion of compressed gaseous fluid in said upper chamber when it is desired to thereby vary the pressure in said lower chamber.

22. In a screen printing machine, a combination comprising an enclosed elongated printing ink receptacle having an upper part, and a lower part provided with a plurality of individual flow-restricting outlet nozzles for outflow of printing ink; admitting means for admitting a body of printing ink into said receptacle; and means for maintaining a cushion of compressed gaseous fluid in said receptacle above said body of printing ink therein, to thereby exert a uniform pressure on the printing ink over the entire elongation of said receptacle and control the outflow of printing ink from said outlet nozzles, said means for maintaining comprising a flexible diaphragm subdividing the interior of said receptacle and completely separating it into a lower chamber in said lower part and containing said body of ink and an upper chamber containing said cushion of compressed gaseous fluid and completely out of communication with said lower chamber, the pressure in each of said chambers being responsive to fluctuations of pressure in the other chamber due to flexing of said diaphragm which is exposed to the pressures in both chambers, and control means for varying the compression of said cushion of compressed gaseous fluid in said upper chamber when it is desired to thereby vary the pressure in said lower chamber.

23. A combination as defined in claim 22, wherein said admitting means comprises a single admitting tube extending axially of said receptacle and communicating therewith over substantially the entire length of the latter.

24. A combination as defined in claim 1, wherein said receptacle has opposite axial ends; and wherein said admitting means comprises a pair of admitting tubes each communicating with and extending into said receptacle from one of said axial ends thereof.

25. A combination as defined in claim 22, wherein said admitting means comprises an admitting tube extending axially of said receptacle in communicating with said lower chamber; and further comprising means for vertically raising and lowering admitting tube said control means comprising

26. A combination as defined in claim 22; further comprising electrical pump means for pumping said printing ink into said lower chamber, and said control means comprising means for energizing and de-energizing said pump means in dependence upon the pressure in at least one chamber, including a switch fixedly mounted adjacent said diaphragm in circuit with said pump means, and a finger on said diaphragm and movable with the same when said diaphragm flexes, so as to energize and de-energize said switch in dependence upon the direction of flexing of said diaphragm.

27. A combination as defined in claim 22, further comprising pump means for pumping said printing ink into said lower chamber; a pressure-responsive device in said receptacle for measuring the pressure prevailing in at least one of said chambers; and an operative connection between said device and said pump so that the latter is energized when said device measures a pressure drop in said receptacle.

28. A combination as defined in claim 22; further comprising pump means for pumping said printing ink into said lower chamber; and means for energizing said pump means when the pressure in at least one of said chambers drops below a first value, and for de-enegizing said pump means when said pressure exceeds a higher second value.

* * * * *